US009088849B2

(12) United States Patent
Bay

(10) Patent No.: US 9,088,849 B2
(45) Date of Patent: Jul. 21, 2015

(54) LOUDSPEAKER

(71) Applicant: Zoltan Bay, Tiszaalpár (HU)

(72) Inventor: Zoltan Bay, Tiszaalpár (HU)

( * ) Notice: Subject to any disclaimer, the term of this patent is extended or adjusted under 35 U.S.C. 154(b) by 0 days.

(21) Appl. No.: 14/348,924

(22) PCT Filed: Sep. 26, 2012

(86) PCT No.: PCT/HU2012/000099
§ 371 (c)(1),
(2) Date: Apr. 1, 2014

(87) PCT Pub. No.: WO2013/050797
PCT Pub. Date: Apr. 11, 2013

(65) Prior Publication Data

US 2014/0321692 A1 Oct. 30, 2014

(30) Foreign Application Priority Data

Oct. 4, 2011 (HU) ..... 1100556

(51) Int. Cl.
*H04R 1/00* (2006.01)
*H04R 9/06* (2006.01)
(Continued)

(52) U.S. Cl.
CPC ..... *H04R 7/16* (2013.01); *H04R 1/403* (2013.01); *H04R 9/063* (2013.01); *H04R 1/323* (2013.01);
(Continued)

(58) Field of Classification Search
CPC ..... H04R 1/00; H04R 3/00; H04R 3/06; H04R 2400/00; H04R 2400/01; H04R 2400/07; H04R 9/06; H04R 9/063; H04R 9/066; H04R 5/02; H04R 7/16; H04R 7/18; H04R 7/20; H04R 7/22; H04R 7/24; H04R 11/00; H04R 11/02
USPC ..... 381/337, 351, 184, 399, 405, 412, 423, 381/161, 162
See application file for complete search history.

(56) References Cited

U.S. PATENT DOCUMENTS 2,915,134 A * 12/1959 Braund ..... 181/156
3,590,942 A * 7/1971 Globa ..... 181/146
(Continued)

FOREIGN PATENT DOCUMENTS

DE 2063662 7/1971
EP 0150976 8/1985
(Continued)

OTHER PUBLICATIONS

Russian Patent Office, International Search Report, Mar. 28, 2013, 2 pgs.
(Continued)

*Primary Examiner* — Khai N Nguyen
(74) *Attorney, Agent, or Firm* — Wood, Herron & Evans, LLP

(57) ABSTRACT

The invention relates to a loudspeaker, which contains bearing structure, a magnetic arrangement (12) fixed to the bearing structure, determining air-gaps (13), and a diaphragm connected to the bearing structure, made of a sheet material. The diaphragm has the shape of a cylindrical jacket consisting of segments (10), the segments (10) are connected to each other along delimiting lines running in the direction of the generating lines, and they have a surface the curvature of which is larger than the curvature that belongs to the overall radius of the cylindrical jacket-like shape, there is a flap (11) at least along two delimiting lines, which flaps (11) extend into an air-gap (13) each radially, and the diaphragm is connected to the bearing structure with flexible supporting units joining the flaps (11) and allowing radial movement of the flaps (11) in the air-gap (13).

20 Claims, 8 Drawing Sheets

Figure 1:
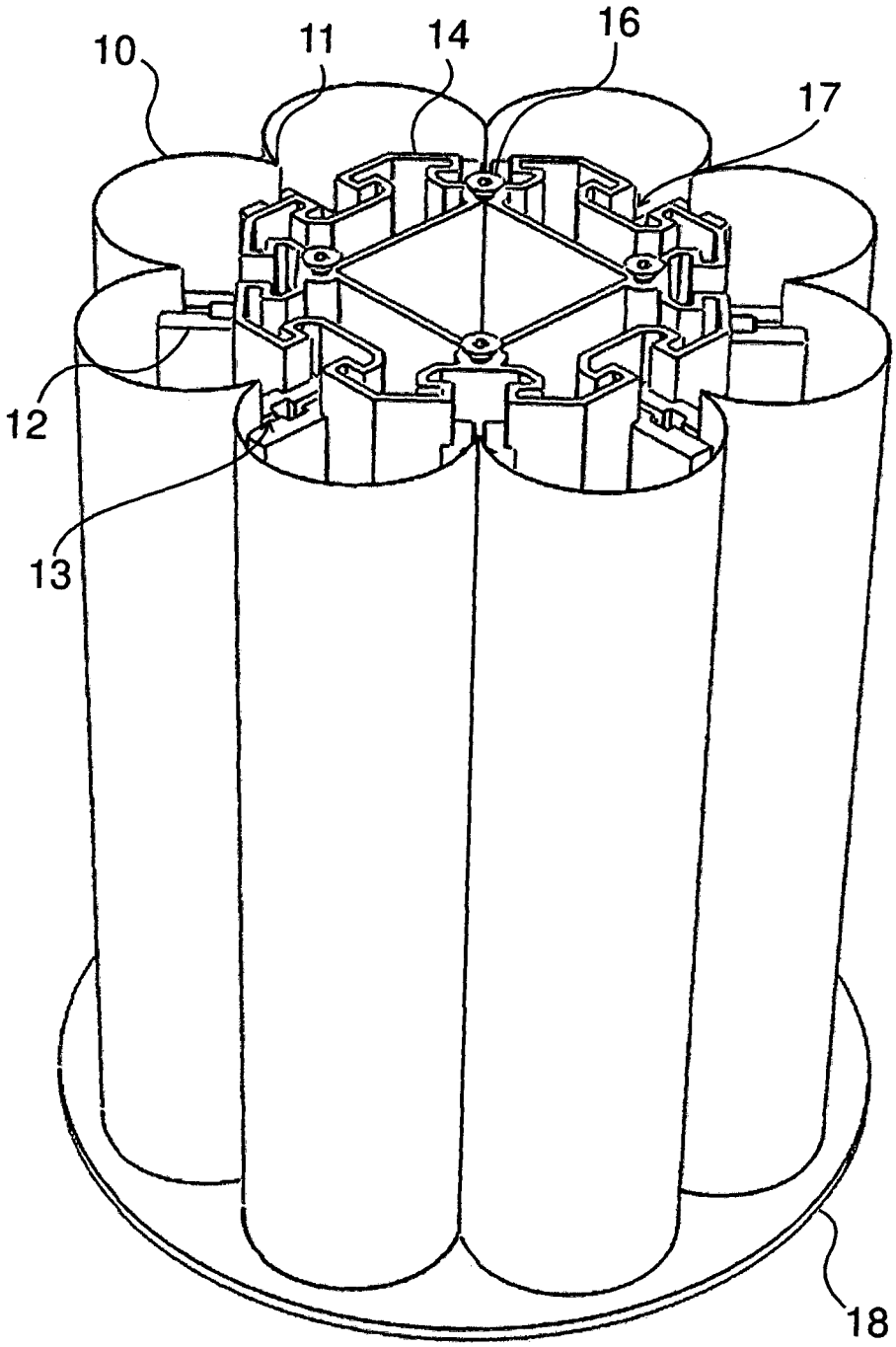

(51) Int. Cl.

| | |
|---|---|
| ***H04R 11/02*** | (2006.01) |
| ***H04R 1/02*** | (2006.01) |
| ***H04R 7/16*** | (2006.01) |
| ***H04R 1/40*** | (2006.01) |
| *H04R 9/02* | (2006.01) |
| *H04R 1/32* | (2006.01) |
| *H04R 7/14* | (2006.01) |
| *H04R 7/20* | (2006.01) |

(52) U.S. Cl.
CPC ... *H04R 7/14* (2013.01); *H04R 7/20* (2013.01); *H04R 9/025* (2013.01); *H04R 9/027* (2013.01); *H04R 2307/201* (2013.01); *H04R 2400/11* (2013.01)

(56) References Cited

U.S. PATENT DOCUMENTS

| | | | | |
|---|---|---|---|---|
| 4,115,667 | A * | 9/1978 | Babb | 381/407 |
| 4,190,746 | A * | 2/1980 | Harwood et al. | 381/427 |
| 4,225,757 | A * | 9/1980 | Babb | 381/407 |
| 4,276,449 | A | 6/1981 | Sawafuji | |
| 5,198,624 | A | 3/1993 | Paddock et al. | |
| 6,009,972 | A * | 1/2000 | Choi et al. | 181/155 |
| 6,134,337 | A * | 10/2000 | Isaka | 381/423 |
| 6,431,308 | B1 | 8/2002 | Vollmer et al. | |
| 6,587,570 | B1 * | 7/2003 | Pavlovic | 381/400 |
| 8,111,870 | B2 * | 2/2012 | Lemarquand et al. | 381/412 |
| 2001/0033673 | A1 * | 10/2001 | Babb et al. | 381/401 |
| 2004/0175016 | A1 * | 9/2004 | Anthony et al. | 381/424 |
| 2006/0262956 | A1 * | 11/2006 | Ishigaki et al. | 381/410 |
| 2008/0002850 | A1 * | 1/2008 | Watanabe et al. | 381/412 |
| 2008/0073993 | A1 * | 3/2008 | Sortore et al. | 310/90.5 |
| 2009/0028374 | A1 * | 1/2009 | Hashimoto et al. | 381/401 |

FOREIGN PATENT DOCUMENTS

| | | | |
|---|---|---|---|
| EP | 0252337 | | 1/1988 |
| FR | 2477821 | | 9/1981 |
| JP | 57021200 | | 2/1982 |
| JP | S57127397 | A | 8/1982 |
| JP | 08102988 | | 4/1996 |
| JP | 2002078079 | A | 3/2002 |
| JP | 2010226330 | A | 10/2010 |
| WO | 0041492 | | 1/2000 |
| WO | 0041492 | A2 | 7/2000 |
| WO | WO 0041492 | A2 * | 7/2000 |

OTHER PUBLICATIONS

European Patent Office, European Search Report in EP Application No. 12838667.9, Feb. 19, 2015 (6 pages).

Japanese Patent Office, Notice of Reason for Refusal in JP Application Serial No. 2014-533996, Mar. 24, 2015, and English language translation thereof. (7 pages).

* cited by examiner

LOUDSPEAKER

This application claims priority, under Section 371 and/or as a continuation under Section 120, to PCT Application No. PCT/HU2012/000099, flied on Sep. 26, 2012, which claims priority to Hungary Application No. P 1100556, filed on Oct. 4, 2011.

The invention relates to a loudspeaker. The subject of the invention is especially a wide-band loudspeaker suitable for omnidirectional sound reproduction.

Numerous loudspeakers of different constructions are known according to the prior art. For example loudspeakers with a so-called strip diaphragm are widely used, as compared to other known types they have smaller distortion and greater load capacity.

A loudspeaker with a strip diaphragm is described for example in document WO 2000/041492 A2. In the solution according to the document the diaphragm is shaped like a strip and is divided into several segments. The diaphragm is moved where the individual segments meet each other. The segments in the two extreme positions are fixed to the bearing structure of the loudspeaker along their longitudinal direction. This known loudspeaker is not suitable for omnidirectional sound reproduction, and the fixed segments in the extreme positions restrict the movement of the diaphragm.

Other loudspeakers are also known that emit sounds in several directions of space, or basically even omnidirectionally.

Omnidirectional loudspeakers are described for example in documents U.S. Pat. Nos. 3,590,942, 6,009,972 and GB 1 451 169. These loudspeakers are constructed with acoustic radiators radiating in different directions situated on the surface of a spatial figure, such as a column, cylinder or sphere. The common disadvantage of these loudspeakers is that several individual acoustic radiators are needed to construct them. Above a certain frequency individual acoustic radiators do not act coherently, which significantly deteriorates radiation characteristics.

Further omnidirectional loudspeakers are described in documents U.S. Pat. Nos. 5,115,882, 5,451,726, 5,673,329, 6,064,744 and 6,431,308 B1. These known loudspeakers produce omnidirectional characteristics with the help of a diffuser. The common disadvantage of these solutions is due to that the diffuser is a frequency-dependent element. In accordance with this certain sound waves are absorbed on the diffuser, and in the case of some of them their phase changes. Consequently it is almost impossible to create a linear frequency response of appropriate phase response.

In documents U.S. Pat. Nos. 5,014,321 and 6,785,397 B2 acoustic radiators with a ball-shaped diaphragm are described, on the lower and upper parts of which there are components moving the diaphragm of the traditional loudspeakers and deforming the diaphragm during operation.

According to document U.S. Pat. No. 6,411,014 B1, with the help of so-called PVDF foil a cylindrical diaphragm is created. The PVDF foil is a multilayer electrostatic radiator; the disadvantage of its use is that it requires supply voltage.

According to document U.S. Pat. No. 6,587,571, a deformable tube is used as a diaphragm, which is pressed together and pulled apart with the help of a magnetic circuit and a coil. The common disadvantage of the cylindrical and tubular solutions is that due to the very slight change in the size of the diaphragm the loudspeaker according to the document operates only at high sound frequencies.

Document EP 0 201 101 A2 describes a loudspeaker with a strip shaped diaphragm.

A loudspeaker with a strip diaphragm is also described in document US 2010/0284560 A1. The loudspeaker described in document CN 201234341Y also has a strip diaphragm. The loudspeaker described in document CN 201260241 Y has a cylindrical diaphragm. A loudspeaker suitable for radiating deep sounds is described in document DE 10 2007016 582 B3. A loudspeaker with a cylindrical diaphragm is described in document GB 2 370 939 A and in document JP 2007-020024.

The common disadvantage of some of the known solutions is that the movement of the diaphragm controlled by the sound frequency drive is restricted by the elements connected to the diaphragm. The common disadvantage of another part of the known solutions is that their radiation characteristics ensure controlled and less perfect omnidirectional sounding. Furthermore, the majority of the known solutions have the disadvantage that they are able to generate sound waves of an even efficiency only in a relatively restricted frequency range.

In the light of the known solutions the demand occurred to develop a loudspeaker, which is suitable for the omnidirectional emission of sound waves with good approximation, and for emitting sounds in a sound frequency range as wide as possible. Furthermore there is demand for developing a loudspeaker, the diaphragm of which is less restricted in free movement than in the case of the known solutions, i.e. it is able to move more perfectly in accordance with the drive.

The primary aim of the invention is to create a loudspeaker, which is free from the disadvantages of the solutions according to the prior art as much as possible. The aim of the invention is to create a loudspeaker, which enables nearly omnidirectional sound radiation. Furthermore, the aim of the invention is to create a loudspeaker, which is able to emit sound waves of even efficiency at sound frequencies as wide as possible. Furthermore, the aim of the invention is to attach the diaphragm of the loudspeaker to the bearing structure of the loudspeaker in such a way that it is restricted in free movement to the smallest possible extent. At the same time the aim of the invention is also to create a flexible supporting unit, which, besides keeping the diaphragm in the appropriate position, allows the movement of the diaphragm according to the drive by hindering it as little as possible.

In respect of the invention the set aims were reached with a loudspeaker according to claim 1.

Figure 2:
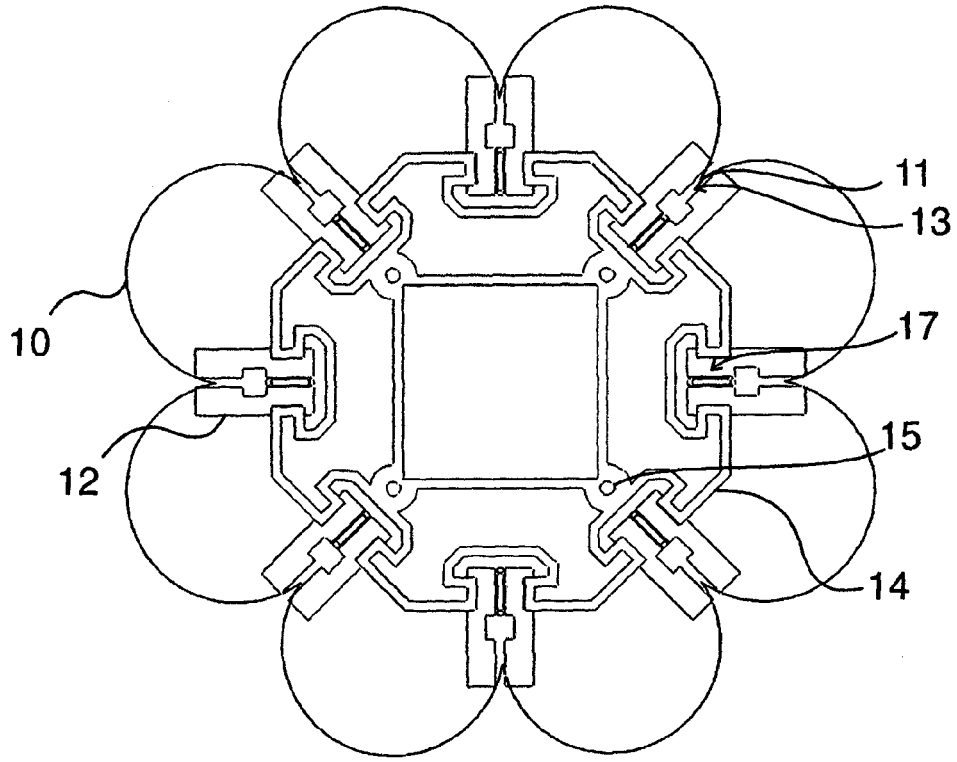
Figure 3:
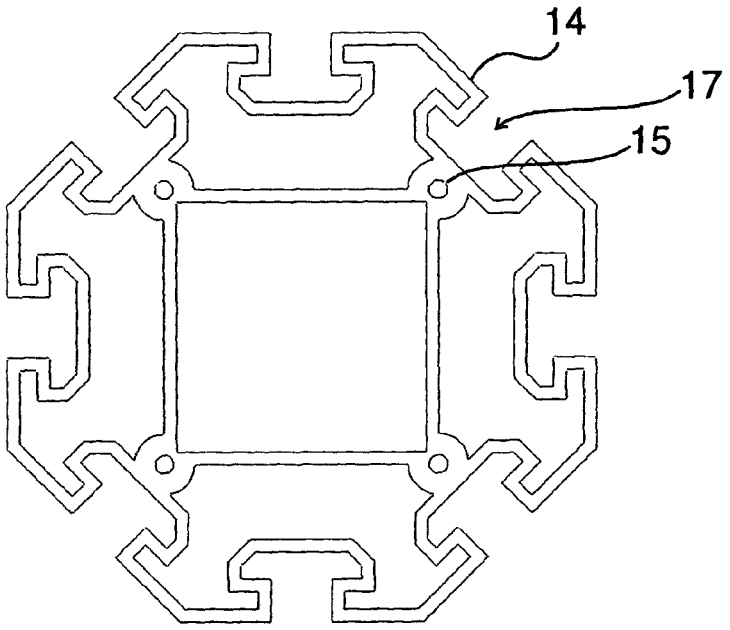
Figure 4:
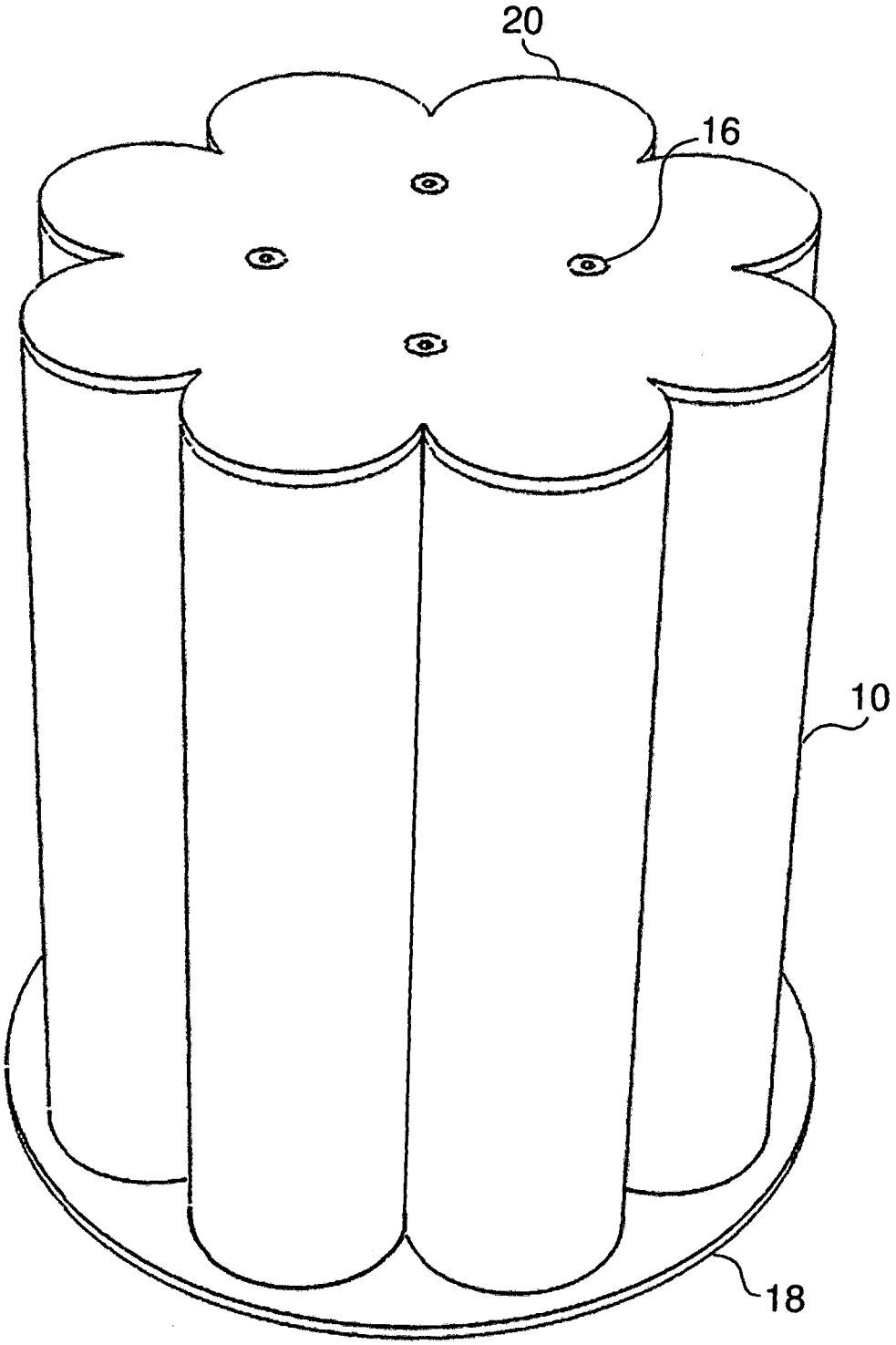
Figure 5:
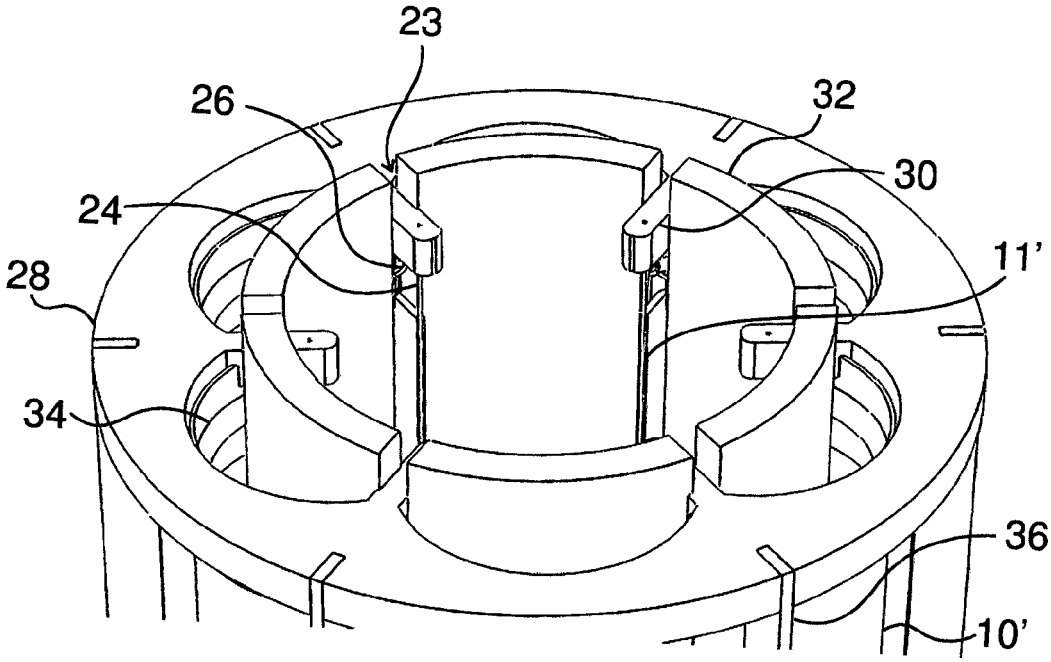
Figure 6:
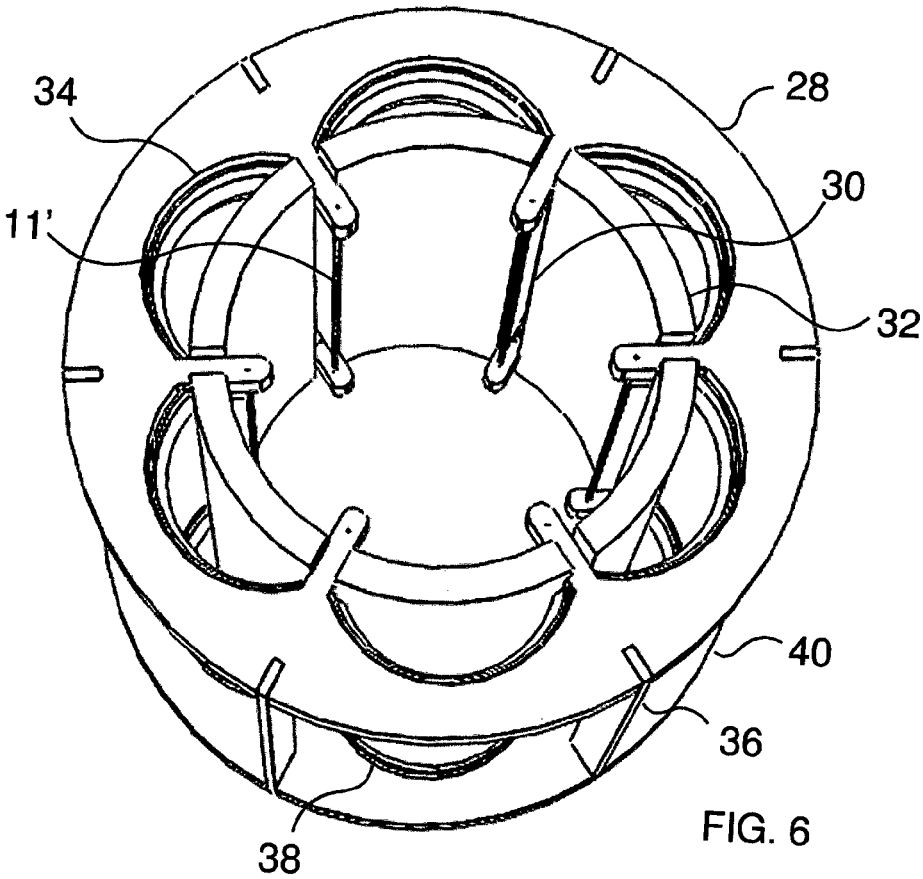
Figure 7:
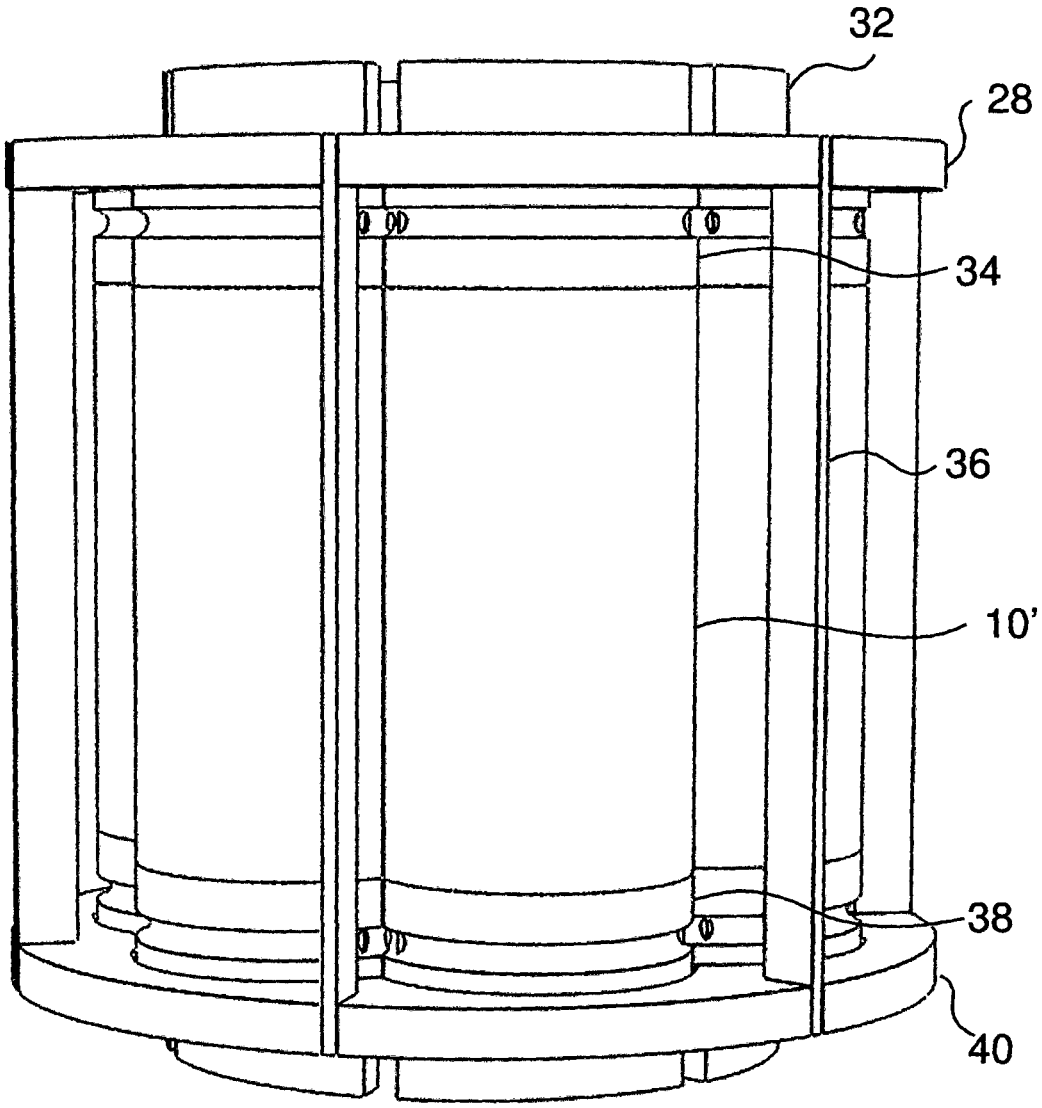
Figure 8:
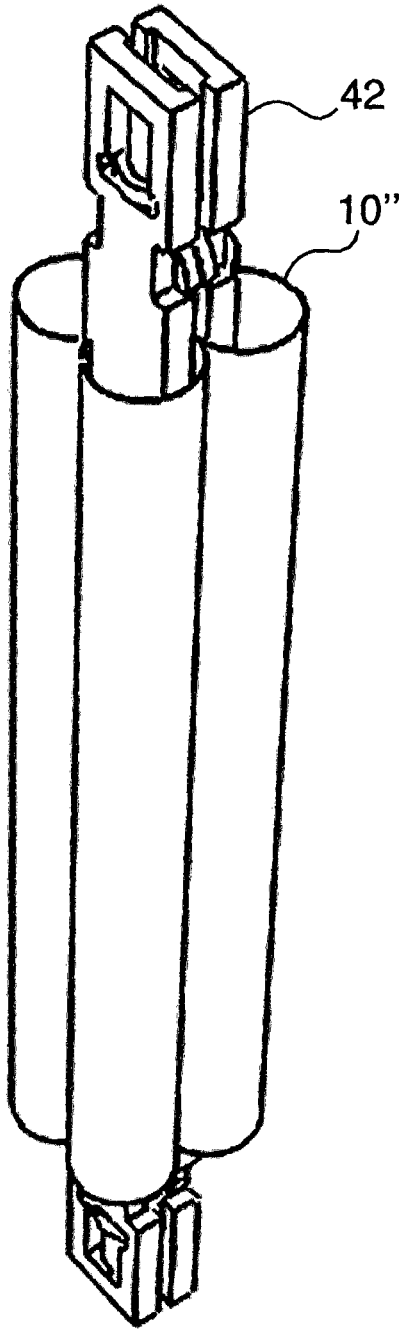
Figure 9:
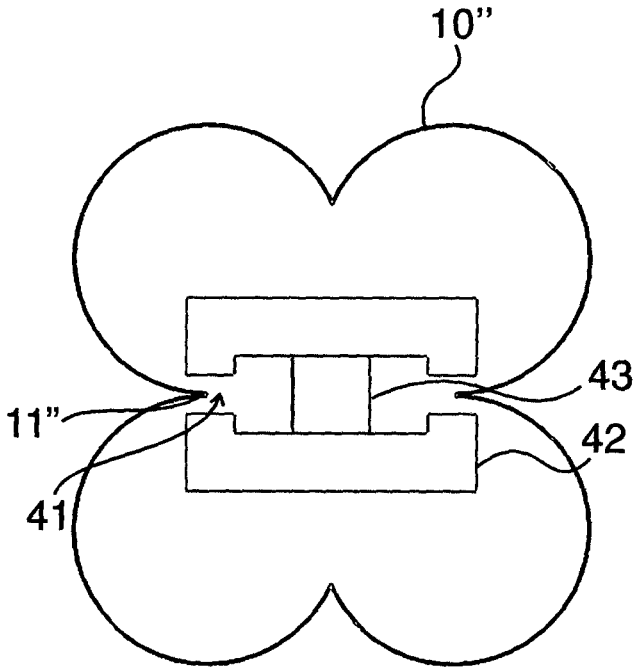
Figure 10:
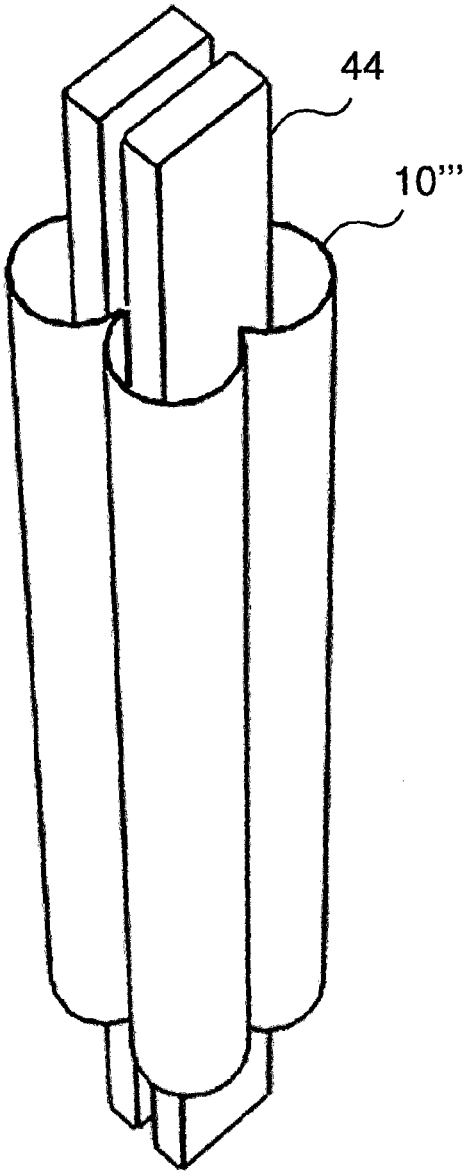
Figure 11:
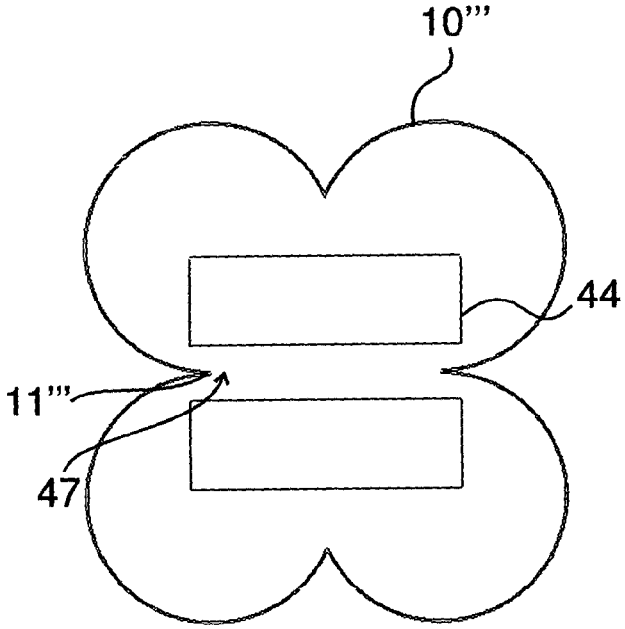
Figure 12:
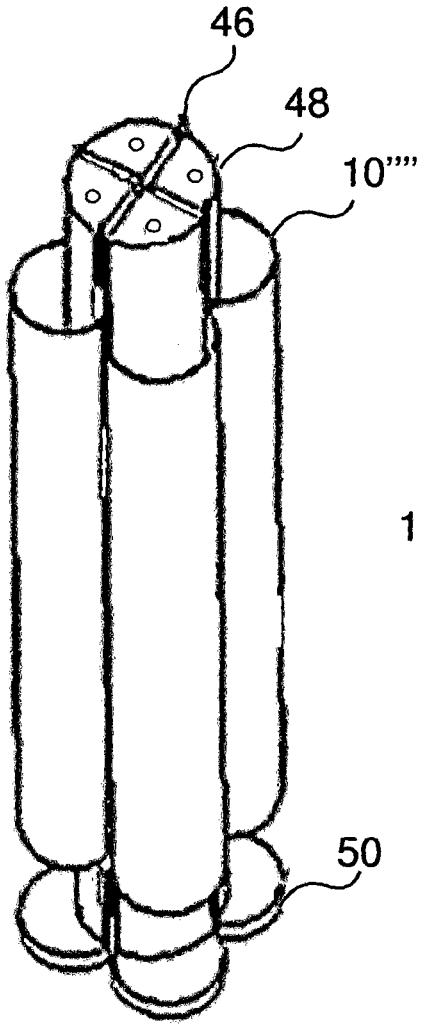
Figure 13:
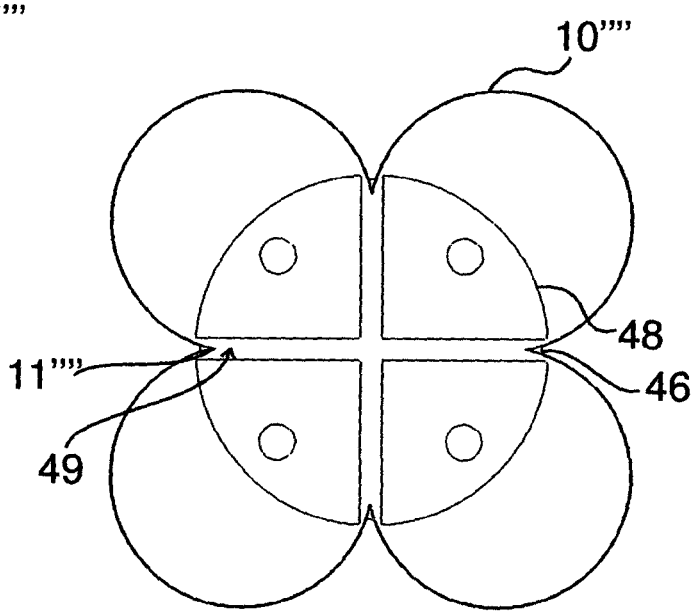

Below favourable forms of execution of the invention, as examples, are described on the basis of drawings, where FIG. 1 is the stereoscopic image of a part of a first form of execution of the loudspeaker according to the invention, FIG. 2 is the top view of the inside of the loudspeaker shown in FIG. 1, FIG. 3 shows an element of the bearing structure of the loudspeaker shown in FIG. 1, in top view, FIG. 4 shows the loudspeaker shown in FIG. 1 with a closing plate mounted, FIG. 5 is the stereoscopic image of a part of another form of execution of the loudspeaker according to the invention, FIG. 6 is the stereoscopic top view of the loudspeaker shown in FIG. 5, FIG. 7 is the lateral view of the loudspeaker shown in FIG. 5, FIG. 8 is the stereoscopic image of a third form of execution of the loudspeaker according to the invention, FIG. 9 is the top view of the loudspeaker shown in FIG. 8, FIG. 10 is the stereoscopic image of a fourth form of execution of the loudspeaker according to the invention, FIG. 11 is the top view of the loudspeaker shown in FIG. 10, FIG. 12 is the stereoscopic image of a fifth form of execution of the loudspeaker according to the invention, FIG. 13 is the top view of the loudspeaker shown in FIG. 12.

All forms of execution of the loudspeaker according to the invention contain a bearing structure, a magnetic arrangement fixed to the bearing structure and determining the air gaps, and a diaphragm sheet material connected to the bearing structure. In the case of the loudspeaker according to the invention sheet material means that when the diaphragm is spread out, it is made of a flat material, favourably by folding and gluing.

In the loudspeaker according to the invention the diaphragm has the shape of a cylindrical jacket consisting of segments. The diaphragm consists of one or more sheet material pieces. Favourably all the segments of the diaphragm are made of one single sheet material piece. The individual segments are connected to each other in such a way that together they form a cylindrical jacket-like shape.

From the aspect of the present invention the cylindrical jacket-like shape means that the surface is determined by generating lines situated along a traceline ending in itself at right angles to the plane of the traceline. Consequently cylindrical jacket-like shape has a permanent cross-section along the direction of the generating lines. The segments join each other along delimiting lines along the direction of the generating lines, and they have a surface the curvature of which is larger than the curvature that belongs to the overall radius of the cylindrical jacket-like shape. The individual segments may be both convex and concave.

There is a flap at least along two delimiting lines, and these flaps extend into an air-gap each radially. The flaps and the air-gap scan be constructed or arranged with respect to each other in several different ways. For the example the flaps can be formed by acute-angled folds created on the sheet material along the joining lines of the segments, or the flaps can be folded surface sections of adjacent segments glued to each other.

In the case that the diaphragm has convex segment curvatures viewed from the internal space of the loudspeaker, the air-gaps determined by the magnetic arrangement are situated in the internal space of the diaphragm delimited by the diaphragm. However, if the segments have a concave construction viewed from the internal space of the loudspeaker, i.e. the individual segments are curved towards the inside, then the magnetic arrangement should be practically organised beyond the internal space delimited by the diaphragm.

Furthermore, according to the invention the diaphragm is connected to the bearing structure with flexible supporting units joining the flaps and allowing radial movement of the flaps in the air-gap. Favourably the flexible supporting units are flexible strands running in the direction of the generating line and connecting the ends of the flaps to the bearing structure, which, when in resting condition, keep the flaps in a loosely suspended position.

The loudspeaker according to the invention also contains a cable arrangement, which contains cable strands attached to the diaphragm along the flaps, going through the air-gaps and ensuring identical current direction in each air-gap. The cable arrangement is responsible for exerting a force on the diaphragm depending on the intensity of the electric current flowing through the cable arrangement and the magnetic induction generated by the magnetic arrangement. It is known that the permanent magnetic field generated by the magnetic arrangement exerts a force on the conductor depending on the current intensity used. With the force exerted in this way the diaphragm can be subjected to sound frequency movement suiting the function of the loudspeaker.

In the loudspeaker according to the invention the diaphragm has a freer construction as compared to the loudspeakers according to the prior art. For this reason the loudspeaker according to the invention is able to provide an even performance in a frequency range wider than in the case of the solutions according to the prior art.

On the basis of the above, the loudspeaker according to the invention is a dynamic acoustic radiator—operating on the basis of the principle of magnetism—, which, due to its diaphragm consisting of segments ensures a large acoustic radiating surface in a small encasing volume and radiates in a 360-degree field around its axis. Consequently the invention is an omnidirectional (360-degree) acoustic radiator. The advantage of this radiation feature is that it provides a more realistic stereo sound image than unipole sound distributors. A further advantage of the solution according to the invention is that the stereo sound image does not get significantly worse, when the acoustic radiator is approached to a surface, for example a rear wall.

With the help of the magnetic arrangements of the loudspeaker according to the invention the direction of the flux in the air-gap and the direction of the current in the conductor is determined in such a way that when current flows through the conductor, all flaps of the diaphragm move radially in the same direction.

FIG. 1 shows a first favourable form of execution of the loudspeaker according to the invention. The loudspeaker according to the present form of execution of the invention contains a diaphragm made of a sheet material, having eight flaps 11, the segments 10 of which joint each other according to the arrangement shown in the figure. In the case of the present form of execution the bearing structure of the loudspeaker consists of a bearing structure element 14, a plate 18 bordering the diaphragm along one edge—the upper edge according to FIG. 1—and a plate 20 bordering the diaphragm along the other edge—the lower edge according to FIG. 1. The plate 20 is shown in FIG. 4. The diaphragm is connected to the bearing structure as described later.

The form of execution according to FIG. 1 contains a magnetic arrangement 12 determining eight air-gaps 13 fixed in the recesses 17 of the bearing structure element 14 created for this purpose. The diaphragm has a cylindrical jacket-like shape consisting of segments 10; the individual segments 10 join each other along delimiting lines along the direction of the generating lines. The delimiting lines are situated at the fold or joint of the flaps 11, and the flaps 11 extend into the air-gaps 13 created by the magnetic arrangement 12 from the outside, as shown in the figure. It can also be seen in the figure that the surfaces of the individual segments 10 have a greater curvature than the radius of the virtual cylinder accommodating the loudspeaker. Due to the larger curvature of the segments the diaphragm is able to expand and contract freely, ensuring by this realistic sound reproduction.

According to the above, the flaps 11 are created along the delimiting lines, and each flap 11 extends into an air-gap 13. The flexible supporting units connecting the diaphragm to the bearing structure are described later.

FIG. 2 is the top view of a part of the form of execution of the loudspeaker according to the invention as in FIG. 1. In FIG. 2 it can be seen in detail that the flaps 11 of the diaphragm extend into the air-gaps 13 created in the magnetic arrangements 12. Favourably one or more cable strands (not shown in FIG. 1 and FIG. 2 for the sake of simplicity) are attached to the diaphragm along the flaps 11, and electric current operating the loudspeaker flows in the cable strands.

FIG. 2 also shows how the magnetic arrangements 12 fit into the recesses 17 created for this purpose on the bearing structure element 14. For example, the magnetic arrangement 12 consists of two soft-iron sections and a permanent magnet clamped between them, as it can be seen in the figure.

FIG. 3 shows the top view of the bearing structure element 14 forming a part of the bearing structure of the form of execution shown in FIG. 1 and FIG. 2. The bearing structure element 14 also contains openings 15 accommodating fixing elements 16.

FIG. 4 also shows a form of execution illustrated with the help of FIG. 1 and FIG. 2, it is closed with a plate 20 forming a part of the bearing structure. In FIG. 4 it can be seen that the plate 20 is fixed to the bearing structure element 14 with the help of fixing elements 16, such as screws.

Favourably the bearing structure element 14 of the form of execution shown in FIGS. 1-4 is a standard drawn aluminium profile. The components of the magnetic arrangement are situated in the recesses 17 of the bearing structure element 14, i.e. in each recess 17 there are two soft-iron sections encasing a flat magnet. The form of execution shown in FIGS. 1-4 is suitable especially for realising a deep-radiating wide-band loudspeaker.

FIG. 5 is the stereoscopic image of a part of another form of execution of the loudspeaker according to the invention. This form of execution of the loudspeaker contains a diaphragm consisting of six segments 10' with six flaps 11. Here the bearing structure contains an end-plate 28 situated near one edge of the diaphragm returning to itself, an end-plate 40 situated near the other edge of the diaphragm, and spacer elements 36 inserted between plate 28 and plate 40. For example the bearing structure holds section magnets 32 known in motor technology, with fingers 30 constructed on plate 28 and plate 40 extending in between the section magnets 32. Consequently the magnetic arrangement of the present form of execution is formed by six section magnets 32 separated from each other by air-gaps 23. The cable arrangement ensuring the operation of the loudspeaker contains cable strands fixed to the diaphragm along the flaps 11', going through the air-gaps 23 and having identical current direction in each air-gap 23. In the figure the connecting cable section 26 continuing in the cable strands can be seen. The diaphragm is connected to the bearing structure with flexible supporting units 24 connected to the flaps 11' and allowing radial movement of the flaps 11' in the air-gap 23. In the case of this form of execution the flexible supporting units 24 are flexible strands running in the direction of the generating line and connecting the ends of the flaps 11' with the bearing structure.

The fingers 30 shown in FIG. 5 are fixation points for the supporting units 24. In the form of execution shown in the figure the fingers 30 extend over the air-gaps 23, i.e. the supporting units 24 connected to the flaps 11' fix the flaps 11' outside the air-gaps 23. At the same time, the cable strands are arranged in such a way that each cable strand is situated in the individual air-gaps 23. In this way, if electric current is taken through the cable strands, the magnetic arrangements exert a force on the cable strands, the intensity of which force depends on the current intensity. As the cable strands are fixed to the diaphragm near the flaps 11', a force of an intensity depending on the current intensity put on the cable strands is exerted on the diaphragm. With this force of a variable intensity the segments 10' of the diaphragm can be moved or vibrated with sound frequency as desired.

FIG. 6 is the top view of the form of execution shown in FIG. 5. In the figure the plate 28 forming the bearing structure, the section magnets 32, the spacer elements 36 and the plate 40 bordering the loudspeaker at the bottom can be seen in detail. Furthermore, the elastic flange 34 connecting the plate 28 and the edge of the diaphragm can also be seen. Typically the elastic flange 34 is a rubber flange, which is made of a soft material in order to influence or prevent the movement of the diaphragm to the least possible extent.

FIG. 7 shows the side-view of the form of execution shown in FIG. 5 and FIG. 6. In the side-view drawing the elastic flanges 34 and 38 bordering the segments 10' of the diaphragm on two sides can be seen. In the side-view drawing it can be seen that the section magnets 32 extend over plate 28 and plate 40 at the lower and upper part of the loudspeaker, ensuring by this the most even magnetic field possible in the air-gaps 23.

Favourably, in this form of execution the loudspeaker contains a closed internal space, which is bordered by the segments 10, 10' of the diaphragm, the bearing structure and the elastic flanges 34, 38.

In the case of the form of execution shown in FIGS. 5-7 the individual elements of the bearing structure can be produced for example by laser cutting, or they can also be made of cut elements.

FIG. 8 and FIG. 9 present a stereoscopic and top-view image of a third form of execution of the loudspeaker according to the invention. This form of execution of the loudspeaker according to the invention contains a diaphragm with two flaps 11" consisting of two segments 10". This form of execution also contains bearing structure elements 42 and 43, which together form the bearing structure of the present form of execution. Air-gaps 41 are formed with the help of the mirror-symmetric bearing structure elements 42 and the bearing structure element 43 between them, also functioning as a spacer. At the same time the bearing structure elements 42 and 43 can also form the magnetic arrangement in such a way that bearing structure elements 42 are soft-iron sections, and bearing structure element 43 is a magnet. The cable, not shown in FIGS. 8 and 9, in which electric current flows during the operation of the loudspeaker and which is needed for moving the diaphragm, is arranged along the flaps extending into the air-gaps 41. Consequently, in the present form of execution the movement of the diaphragm needed for the operation of the loudspeaker according to the invention is reached by moving the flaps 11" extending into the air-gaps 41 as described above. The segments 10" also contain a folding line along their curve suiting the direction of the central generating line, the advantage of which is that they ensure greater longitudinal strength for the segments 10" and reduce distortions resulting from the twisting of the segments 10".

FIG. 10 and FIG. 11 present a stereoscopic and top-view image of a further different form of execution of the loudspeaker according to the invention. The present form of execution contains a diaphragm consisting of segments 10''' and having flaps 11''', and bearing structure elements 44 with an air-gap 47. The spacer between the bearing structure elements 44 is not shown in FIG. 10 or 11. In the present form of execution the bearing structure elements 44 themselves are permanent magnets, and they form the magnetic arrangement. The cables needed for the appropriate movement of the diaphragm are situated along the flaps 11''' extending into the air-gaps 47, following a similar arrangement as n the case of the form of execution presented in FIGS. 8 and 9. Furthermore, in FIG. 11 there is also a spacer disc 52 and a retaining unit 54 connected to the disc 52. The spacer disc 52 is connected to both bearing structure elements 44.

The embodiment presented in FIGS. 10 and 11 can be formed with a retaining unit fixing the segments 10''' of the diaphragm to a spacer disc at the flaps 11'''. In the case of the present form of execution the flexible retaining units are flexible strands running in the direction of the generating line, connecting the ends of the flaps 11 ''' to the bearing structure, i.e. to the bearing structure elements 44 via the spacer disc and the flexible strands are cable strands, favourably with a flexible coating.

FIGS. 12 and 13 present of a further different form of execution of the loudspeaker according to the invention. Similarly to the previous two forms of execution, there is o closed acoustic space in this form of execution either. The present form of execution contains a diaphragm consisting of segments 10'''' and having flaps 11'''', and a bearing structure element 48 on which there are air-gaps 49, The individual flaps 11'''' extend into the individual air-gaps 49. In the figures it can be seen that there are cables 46 along the flaps 11'''' arranged in such a way that they are glued onto the diaphragm inside the folds forming the flaps 11'''', that is from the outside. In the present form of execution the magnetic arrangement can be formed by the bearing structure elements 48 themselves, but the magnetic arrangement may also be situated along the surfaces bordering the air-gaps 49.

In the case of the forms of execution shown in FIGS.8-13 the retaining units fixing the diaphragm to the bearing structure arc favourably flexible strands connecting the ends of the 11'', 11''', 11'''' to the bearing structure. Even more favourably, the flexible strands are formed by the cable strands themselves. In this case the sections of the cable strands forming the flexible strands are favourably provided with a flexible coating.

It is pointed out that the cable arrangement fixed to the diaphragm and responsible for moving the diaphragm is not shown in the figures. The cable arrangement running on the diaphragm can be realised using any suitable method, for example the method described in document WO 2000/041492 A2.

It is pointed out that it is necessary to create a closed acoustic space for the appropriate operation of the loudspeaker only if the emitted sound waves have a relatively large wavelength. In this case the sound waves coming from two different sides of the diaphragm may extinguish each other. In the case of smaller wavelength generation no such extinguishing can be considered, so no closed acoustic space needs to be created.

The forms of execution with a diaphragm consisting of several segments, having several generation points and also a closed internal space are suitable especially for radiating deeper sounds. Forms of execution with a diaphragm constructed from fewer segments and having fewer generation points are suitable especially for radiating higher sounds. In the case of forms of execution used for high sounds it is not necessary to create a closed acoustic space.

With suitable parameters the invention can be suitable for ensuring a loudspeaker, which covers approximately the entire sound frequency range. A further significant advantage of the loudspeaker according to the invention is that as compared to the known acoustic radiators it contains a significantly larger diaphragm surface without losing its favourable characteristics. By increasing the number of segments the surface of the diaphragm increases without weakening the radiation parameters. In the case of the same deflection the larger diaphragm surface results in larger acoustic pressure.

Further modifications of the loudspeaker according to the invention are also possible, with which the radiation efficiency can be increased. A possible solution for this—especially in deeper ranges—is that the internal space of the loudspeaker is connected to an acoustic cavity in such a way that one end of the internal space is connected to the acoustic cavity, while the other end is closed. According to another possible solution a funnel for acoustic fitting is placed on the open sides of the internal space; consequently, here they are not closed with the bearing structure elements.

As compared to the known dynamic sound radiating solutions, the solution according to the invention makes it possible to create a significantly larger diaphragm surface so that it is capable of direct acoustic radiation in a 360-degree field. By increasing the number and size of the segments a loudspeaker with a nearly unlimited surface can be constructed. The surface of the known dynamic cone acoustic radiators cannot be increased unlimitedly, as the moving coil controls the diaphragm from one single point, and if the surface of the diaphragm is increased, the moved mass also increases, and the larger the diameter of the diaphragm is—as its stiffness is not infinite—the more independently it moves, which significantly deteriorates sound reproduction.

Other diaphragm constructions different from the above are also possible. In the case of creating a number of segments other than shown above, the bearing structure and the magnetic arrangements must also be changed accordingly, i.e. an appropriate number of air-gaps must be created for accommodating flaps, on which the cable strands run needed for the operation of the loudspeaker as described above. It is emphasised here that from the aspect of the invention it is irrelevant whether the diaphragm contains an even or odd number of segments. Favourably the diaphragm of the loudspeaker according to the invention can be derived from a tubular shape, on which a number of edges suiting the number of segments is folded; in this way a shape similar to that of a flower petal shown in the figures is realised. The diaphragm created in this way, when it is moved in radial direction at the folded edges, is able to change its diameter and surface easily and change by this the volume of the air entrapped in it.

It may be favourable, if the cable arrangement that belongs to the flaps extending into the air-gaps contains a pair of connecting cable sections per air-gap or per pair of air-gaps. In this case the individual flaps or pairs of flaps can be controlled independently from the others. Forms of execution are also possible, in which the cable arrangement contains one single common pair of connecting cable sections.

This latter construction is especially favourable in the case of forms of execution, where the segments of the diaphragm are made of flexible printed circuit boards. In this case the cable arrangement or cable pattern of the printed circuit boards can be realised on the printed circuit boards in such a way that at the glued places forming the flaps the appropriate cable strands are linked to each other. Consequently, on the printed circuit boards the entire diaphragm cable arrangement is created in advance, and favourably only one single common pair of connecting cable sections belongs to the entire cable arrangement. If double-sided printed circuit boards are used, at the individual flaps four cable strand layers can be realised, with which the loudspeaker can be made even more sensitive. By using multi-sided printed circuit boards the sensitivity of the loudspeaker can be increased even more.

If a pair of connecting cable sections is created for each pair of air-gaps, due to the cable strands arranged in a coil the current flows in the air-gaps in the opposite direction. However, with the appropriate construction of the magnetic arrangement (opposed polarity) in the pairs of air-gaps forces of the same intensity, all pointing radially inwards or outwards are exerted onto the individual flaps, so the diaphragm is moved with the same radial force everywhere. Examples of such constructions can be seen in FIGS. 8-11.

When constructing the cable arrangements, favourably the looseness of the cables strands of the pair of connecting cable sections is ensured. If the cable strands are not left loose, they do not influence the operation of the loudspeaker according to the invention, if their resonance frequency is beyond the transmitted frequency range. The cable strands forming the cable arrangement, especially at the pair of connecting cable sections, are provided with a flexible coating preventing them from breaking.

The flexible retaining units can be constructed in several different ways. From the aspect of constructing the flexible retaining units it is important that they should be connected to the flaps created on the diaphragm. The flexible retaining units are constructed in such a way that they must enable the free movement of the flaps needed for the operation of the loudspeaker. At the same time the retaining units are responsible for returning the diaphragm into its rest position in unloaded condition.

It may be favourable, if the cable arrangement and the retaining unit is constructed in such a way that the retaining unit is formed by the cable strands themselves and by the cable bundles formed by them. Such diaphragm suspension is favourable for example in the case of the forms of execution shown in FIGS. 8-13.

Favourably the diaphragm is constructed with rotational symmetry. By this free vibrations of the diaphragm, which may result in the appearance of undesired subharmonics, can be avoided.

Favourably the elastic flange is made of soft rubber, which does not hinder the movement of the diaphragm. For example the elastic flange can even be fixed or glued to the diaphragm, when it still has the shape of a flat sheet.

Obviously the invention is not restricted to the favourable forms of execution described in detail, but further versions, combinations, modifications and developments are also possible within the scope of protection determined by the claims.

List Of References

10 segment
10' segment
10" segment
10''' segment
10'''' segment
11 ear
11' ear
11" ear
11''' ear
11'''' ear
12 magnetic arrangement
13 air-gap
14 bearing structure element
15 opening
16 fixing element
17 recess
18 plate
20 plate
23 air-gap
24 retaining unit
26 connecting cable section
28 plate
30 finger
32 section magnets
34 elastic flange
36 spacer element
38 elastic flange
40 plate
41 air-gap
42 bearing structure element
43 bearing structure element
44 bearing structure element
46 fixing element
47 air-gap
48 bearing structure element
49 air-gap
50 plate
52 spacer disc
54 retaining unit.

The invention claimed:

1. A loudspeaker comprising:
a bearing structure;
a magnetic arrangement fixed to the bearing structure, the magnetic arrangement defining air-gaps, and
a diaphragm connected to the bearing structure, made of a sheet material, characterized by:
the diaphragm has a cylindrical jacket-like shape consisting of segments;
the segments are connected to each other along delimiting lines running in the direction of the generating lines, and they have a surface curvature of which is larger than a curvature that belongs to an overall radius of the cylindrical jacket-like shape;
there are flaps at least along two delimiting lines, which the flaps extend into the air-gaps each radially; and
the diaphragm is connected to the bearing structure with flexible supporting units joining the flaps and allowing radial movement of the flaps in the air-gaps.

2. The loudspeaker of claim 1, characterized by that the flexible supporting units connecting the ends of the flaps with the bearing structure are flexible strands running in the direction of the generating lines.

3. The loudspeaker of claim 2, characterized by that the flexible strands are cable strands, favorably with a flexible coating.

4. The loudspeaker of claim 1, characterized by that it contains a cable arrangement, which contains cable strands attached to the diaphragm along the flaps, going through the air-gaps (13, 23, 41, 47, 49) and ensuring identical current direction in each air-gap (13, 23, 41, 47, 49).

5. The loudspeaker of claim 4, characterized by that the cable arrangement contains a pair of connecting cable sections per air-gap or per pair of air-gaps.

6. The loudspeaker of claim 4, characterized by that the cable arrangement contains one single common pair of connecting cable sections.

7. The loudspeaker of claim 1, characterized by that the segments (10, 10', 10", 10''''10'''') of the diaphragm are made of flexible printed circuit boards.

8. The loudspeaker of claim 1, characterized by that all the segments of the diaphragm are made of one single sheet material piece.

9. The loudspeaker of claim 1, characterized by that the edges of the segments of the diaphragm are connected to the bearing structure via an elastic flange.

10. The loudspeaker of claim 9, characterized by that it contains an internal space enclosed by the segments of the diaphragm, the bearing structure and the elastic flanges.

11. A loudspeaker comprising:
a bearing structure;
a magnetic arrangement fixed to the bearing structure, wherein the magnetic arrangement defines a plurality of air gaps;
a cylindrical diaphragm connected to the bearing structure, wherein the diaphragm includes a plurality of curved segments connected to each other along a plurality of delimiting lines to form a plurality of flaps, wherein a surface of each segment in the plurality of segments includes a radius of curvature larger than a radius of curvature of the diaphragm;

wherein each flap in the plurality of flaps extends into one of the air gaps in the plurality of air gaps; and a plurality of flexible supporting units joining the flaps to the bearing structure, wherein the plurality of flexible supporting units allow radial movement of each flap in the corresponding air gap.

12. The loudspeaker of claim 11 further comprising:

a cable arrangement, wherein the cable arrangement includes a plurality of cable strands, wherein each cable strand in the plurality of cable strands is attached to a corresponding one of the flaps in the plurality of flaps, and wherein the cable arrangement ensures identical current direction in each air gap in the plurality of air gaps.

13. The loudspeaker of claim 11, wherein each flexible supporting unit in the plurality of flexible supporting units is comprised of a plurality of flexible strands extending parallel to the delimiting lines.

14. The loudspeaker of claim 11, wherein each segment in the plurality of segments is comprised of a flexible printed circuit board.

15. The loudspeaker of claim 11, wherein the cylindrical diaphragm is comprised of a single piece of a sheet material.

16. A loudspeaker comprising:

a bearing structure;

a magnetic arrangement fixed to the bearing structure, wherein the magnetic arrangement defines an air gap;

a cylindrical diaphragm connected to the bearing structure, the cylindrical diaphragm comprising:

a diaphragm radius of curvature;

a first curved segment having a first surface with a first radius of curvature;

a second curved segment having a second surface with second radius of curvature;

a flap, wherein the first curved segment is connected to the second curved segment along a delimiting line to form the flap, and wherein the flap extends into the air gap;

wherein the first radius of curvature is larger than the diaphragm radius of curvature; and wherein the second radius of curvature is larger than the diaphragm radius of curvature; and a flexible supporting unit, wherein the flexible supporting unit joins the flap to the bearing structure, and wherein the flexible supporting unit allows radial movement of the flap in the air gap.

17. The loudspeaker of claim 16, wherein the flexible supporting unit is comprised of a plurality of flexible strands extending parallel to the delimiting line.

18. The loudspeaker of claim 16, wherein the flexible supporting unit is comprised of an elastic flange.

19. The loudspeaker of claim 16, wherein the first curved segment is comprised of a flexible printed circuit board, the second curved segment is comprised of a flexible printed circuit board, or both.

20. The loudspeaker of claim 16, wherein the first curved segment and the second curved segment are comprised of a single piece of a sheet material.

* * * * *